US006672274B2

(12) United States Patent
Winterpacht

(10) Patent No.: US 6,672,274 B2
(45) Date of Patent: Jan. 6, 2004

(54) ROTARY PISTON INTERNAL COMBUSTION ENGINE

(76) Inventor: Hubert Winterpacht, Kohlenstr. 192, Hattingen, 45529 (DE)

( * ) Notice: Subject to any disclaimer, the term of this patent is extended or adjusted under 35 U.S.C. 154(b) by 0 days.

(21) Appl. No.: 10/249,816

(22) Filed: May 9, 2003

(65) Prior Publication Data

US 2003/0159674 A1 Aug. 28, 2003

Related U.S. Application Data

(63) Continuation of application No. PCT/DE01/04173, filed on Nov. 8, 2001, now abandoned.

(30) Foreign Application Priority Data

Nov. 10, 2000 (DE) ..... 100 55 906
Apr. 19, 2001 (DE) ..... 101 19 146

(51) Int. Cl.[7] ..... F02B 53/04
(52) U.S. Cl. ..... 123/232; 123/246; 123/231; 418/191
(58) Field of Search ..... 123/246, 232, 123/231; 418/191, 196, 197, 198

(56) References Cited

U.S. PATENT DOCUMENTS 1,446,079 A * 2/1923 Wood ..... 123/232
1,507,979 A * 9/1924 Staaf ..... 123/232
2,215,096 A * 9/1940 Fanberg ..... 123/238
2,742,882 A * 4/1956 Porter ..... 123/246
3,401,676 A * 9/1968 Wanzenberg ..... 123/232
3,940,924 A * 3/1976 Miyada ..... 418/191

FOREIGN PATENT DOCUMENTS

| | | | |
|---|---|---|---|
| DE | 29 31 943 | 2/1981 | |
| DE | 3131258 A1 * | 3/1983 | ..... F01C/1/20 |
| DE | 3429867 A1 * | 10/1985 | ..... F02B/53/00 |
| DE | 43 25 454 | 2/1995 | |
| DE | 44 17 915 | 11/1995 | |
| DE | 196 06 541 | 7/1996 | |
| FR | 1 320 880 | 3/1963 | |
| GB | 992 060 | 5/1965 | ..... F01C/1/20 |

* cited by examiner

*Primary Examiner*—Thomas Denion
*Assistant Examiner*—Thai-Ba Trieu
(74) *Attorney, Agent, or Firm*—Gudrun E. Huckett

(57) ABSTRACT

A rotary internal combustion engine has a housing and a working wheel mounted rotatably in the housing. At least one working piston is provided on the working wheel for taking in and compressing air or a fuel-air mixture and for converting gas pressure resulting from combustion of the fuel-air mixture into mechanical energy. A counter wheel with a working piston recess is provided. A combustion chamber for combusting a fuel-air mixture is formed in operation continuously anew between working piston, working wheel, counter wheel, and housing. First air vanes form spokes of the working wheel and take in the fuel-air mixture or the air through the working wheel for pre-compression of air or of a fuel-air mixture. The wheel is pulley-shaped and has an annular channel extending in a circumferential direction. The working piston is arranged fixedly in the annular channel.

22 Claims, 11 Drawing Sheets

ROTARY PISTON INTERNAL COMBUSTION ENGINE

CROSS REFERENCE TO RELATED APPLICATIONS

This is a continuation of International Application PCT/DE01/04173 with an international filing date of Nov. 8, 2001, not published in English under PCT Article 21(2), and now abandoned.

BACKGROUND OF INVENTION

The invention relates to a rotary piston internal combustion engine. In particular, the invention relates to a rotary piston internal combustion engine comprising a housing; at least one working wheel rotatable about an axis of rotation in the housing; at least one working piston provided on the working wheel for taking in and compressing air or a fuel-air mixture and for converting the gas pressure resulting from the combustion of a fuel-air mixture into mechanical energy; at least one counter wheel with at least one working piston recess; a number of first air vanes driveable in rotation for pre-compression of air or a fuel-air mixture; and at least one combustion chamber for combusting a fuel-air mixture.

Because of the rotary movement of the working piston during operation, such internal combustion engines are generally referred to as rotary piston internal combustion engines or, for short, rotary piston engines.

In this connection, it should be noted that the term axis of rotation about which the working wheel and the one or more pistons rotate during operation is not a physically embodied axle (the latter will always be referred to in the following as shaft but the physical line through the center of the rotary movement.

Internal combustion engines are divided, based on the type of movement of the working piston, i.e., that moved part which is pushed when combusting a fuel-air mixture by the resulting gas pressure, in reciprocating piston engines and rotary piston engines.

In this connection, it has been known for a long time that reciprocating piston engines require because of the translatory piston movement crank gears for conversion of the translatory movement into a rotary movement; such crank gears are highly stressed because of the forces resulting from the continuously occurring acceleration and deceleration of the pistons in particular with respect to their guides and bearings.

In contrast to this, rotary piston internal combustion engines do not have translatorily moved pistons and connecting rods, and the one or more pistons move on a circular path always in the same direction during operation so that they must not be constantly decelerated and accelerated in the opposite direction as is the case for reciprocating pistons.

The best known representative of the design of the rotary piston internal combustion engine is the Wankel engine named after its inventor. In the Wankel engine, a piston having a cross-section similar to a triangle rotates in a cylinder of a special shape. Because of sealing problems and the resulting high fuel consumption, the engine has not found acceptance despite the advantages residing in its configuration.

The German published document 29 31 943 A1 discloses a rotary piston internal combustion engine wherein two working pistons are arranged on a working wheel which is rotatably supported in a housing, wherein the working wheel is perforated in an area near the axis of rotation and is embodied as a fan wheel by means of angularly positioned stays so that the working wheel is advantageously cooled from the interior. The combustion of the fuel-air mixture is carried out in this engine in a separate combustion chamber which results in a complex configuration of the engine.

The German published document 44 17 915 A1 discloses a rotary piston internal combustion engine in which four pistons are arranged on a working wheel of which each one is embodied as a spherical piston, wherein the pistons in operation move into recesses in a counter wheel and thus form in the counter wheel a combustion chamber, wherein the pressure forces resulting from combustion act only partially in the direction of the actual circular movement of the piston so that significant forces must be taken up by the counter wheel.

The German published document 31 31 258 A1 discloses a rotary piston internal combustion engine comprising a working wheel and a compression wheel which are arranged on a common shaft. The compression wheel supports several compression pistons for compressing the fuel-air mixture which is then forced into a combustion chamber formed between the compression wheel and the blade wheel where ignition takes place. The combusted gases are moved from the combustion chamber to the working wheel where they can act on the working pistons. Intake into and exhaust from the combustion chamber are realized by a relatively complex valve control. Moreover, cooling of the working wheel and of the working pistons is problematic in this engine.

An engine which is similar to the last described engine is disclosed in the German published document DE 43 25 454 A1 in which also two piston-supporting wheels are arranged on a common shaft, with one serving for compressing air or a fuel-air mixture and the other for converting the gas pressure resulting from combustion into a rotary movement. Here, combustion is also taking place in a separate combustion chamber.

The known rotary piston internal combustion engines are relatively complex and, accordingly, require high production and maintenance expenses. Moreover, the known rotary piston internal combustion engines, despite research and development having been carried out sometimes over years, are still not optimal so that practically no rotary piston internal combustion engines can be found on the market.

SUMMARY OF INVENTION

It is therefore the object of the invention to provide a rotary piston internal combustion engine which has the advantages of a rotary piston engine resulting from its configuration and avoids the aforementioned disadvantages of known rotary piston internal combustion engines.

A rotary piston internal combustion engine is proposed comprising a housing; at least one working wheel rotatable in the housing about an axis of rotation; at least one working piston provided on the working wheel for compressing air or a fuel-air mixture and for converting the gas pressure resulting from the combustion of a fuel-air mixture into mechanical energy; at least one counter wheel with at least one working piston recess; several first air vanes driveable in rotation for pre-compressing air or a fuel-air mixture; and at least one combustion chamber for combusting a fuel-air mixture, wherein the at least one combustion chamber in operation is formed continuously anew between the working piston, working wheel, counter wheel, and housing, and wherein the first air vanes form, like spokes, a part of the working wheel and in operation take in the fuel-air mixture or the air through the working wheel substantially parallel to the axis of rotation of the working wheel.

The invention provides several advantages. For example, the gaseous medium, which generally is air but can however also be a fuel-air mixture, taken in through the working wheel cools the working wheel from the interior.

As a result of the perforated configuration of the working wheel with the air vanes acting as spokes, the working wheel has a high stability while having a relatively minimal weight.

The one or more working pistons provide a double function, respectively. When they move toward the counter wheel, they compress the already pre-compressed air, optionally also the already formed fuel-air mixture; after passage through the corresponding working piston recess in the counter wheel they act as a moveable wall of the combustion chamber which is pushed away by the gas pressure resulting from combustion.

The working wheel with the air vanes and one or several working pistons thus even has three functions: pre-compression, compression, work.

As a result of this multi-functionality of the components a simple configuration of the engine with minimal weight and minimal cost and high reliability is enabled. In a preferred embodiment, the output is realized by an output shaft which is arranged at the center of the working wheel whose axis of rotation is identical with the axis of rotation of the working wheel. Advantageously, the first air vanes can directly or indirectly (by a gearbox) engage the output shaft and, in this way, can transmit the mechanical energy received from the one or more pistons onto the output shaft from where it is then transmitted in a way known in the art and can be used, for example, for driving a vehicle. When the axis of rotation of the output shaft and of the working wheel coincide, this has advantages with respect to the support action and balancing.

Alternatively, it is also possible to provide an output shaft whose axis of rotation does not coincide with the axis of rotation of the working piston. The drive of the output shaft can then be realized, for example, by means of a gear rim provided on the working wheel which drives the output shaft directly or indirectly.

In an advantageous further configuration, several second air vanes that can be driven in rotation can be provided for additional pre-compression of air or of a fuel-air mixture. These second air vanes can be spoke-like parts of a gear rim and can also engage the output shaft. These spoke-shaped vanes then have a profile that, as is conventional in compression stages of a turbine, provide compression of the conveyed medium when rotated about the axis of rotation. It was found to be expedient in this connection to connect the gear rim with the second air vanes fixedly to the working wheel. When such a gear rim is provided, this gear rim with the second air vanes can be in meshing engagement with an at least partially complementary gear rim on the counter wheel. In this way, a reliable forced control of the counter wheel is realized. At the same time, when starting the engine, the working wheel can be rotated by means of the gear rim. Since the engine is actively filled in the area of the combustion chamber and has no suction function, a rotation of the working wheel caused by the starter can effect a first filling for starting the engine.

For a simple, low-maintenance, and reliable support of the working wheel and thus of the most important rotating parts of the engine, slide bearings can be provided in the housing between the inner side of the housing and the outer side of the working wheel facing the housing.

Moreover, a reservoir for receiving the gaseous medium (air or fuel-air mixture) compressed in operation by a working piston can be provided where the working piston passes the counter wheel, wherein the reservoir, for example, can be semi-cylindrical or toroidal and can be part of the housing or a separate component attached to the housing. An especially compact configuration of the engine results when the reservoir is located in the counter wheel itself, i.e., forms a part of the counter wheel. For this purpose, the counter wheel can be provided with openings and corresponding valves which are controlled in particular by spring elements or hydraulically. The gaseous medium which is compressed by a working piston upon movement toward the counter wheel is forced into a chamber formed in the counter wheel and serving as a reservoir and, after the piston has passed, is released again.

In a further preferred embodiment in which the rotary piston internal combustion engine has at least two working pistons arranged on a common working wheel, at least one intake port and one exhaust port are provided in the housing. In certain rotational positions of two neighboring working pistons, the intake port and the exhaust port are open at the same time so that it is possible to guide flushing air through the intake port into the space which is formed between the two neighboring working pistons, the housing and the working wheel. In this way, possibly still retained exhaust gases in the space are reliably pushed out. This so-called flushing air can be advantageously the gaseous medium which is taken by the first, and optionally the second, air vanes wherein the medium in this configuration is, of course, not the fuel-air mixture but air. The fuel or a fuel-air mixture is added at a later time, in particular, by means of an injection nozzle arranged behind the counter wheel.

Behind the compressor stage, which is formed by the first and second air vanes, an exhaust gas turbocharger is provided in a preferred embodiment which is capable of additionally compressing the taken-in ambient air. This exhaust gas turbocharger can be configured as a so-called soft turbocharger which generates a charge pressure which increases continuously with the engine speed.

The working pistons can be configured as solid components; preferably, they are provided with cooling means. The cooling means in one embodiment can be embodied as charging air cooling which cools the ambient air which has been taken in by the compressor stage. Another preferred embodiment comprises an active piston cooling means in which the first air vanes are essentially arranged centrally below the working pistons, wherein the working pistons have a U-shaped cooling channel. This cooling channel is flow-connected with one end with the intake side arranged in front of the compressor stage and with the opposite end with the pressure side arranged behind the compressor stage. As a result of the pressure drop along the compressor axis, an air flow through the cooling channel is formed in this configuration. In this way, a simple and efficient cooling of the working piston is ensured.

The working wheel can drive the counter wheel also by means of other drive means. This can be, for example, a drive chain which, like a control chain in conventional reciprocating piston motors, connects the gear rim of the working wheel with the complementary gear rim of the counter wheel instead of providing a direct toothed connection. Important in this connection is only the correct configuration of the transmission ratio because it must be ensured at any time that the working piston engages the working piston recess; this can be realized by the engine speed ratio required in this connection. Further features and advantages of the invention result from the dependent claims and the following description of preferred embodiments.

DETAILED DESCRIPTION

In the following, reference being had to the drawings, different advantageous embodiments of the rotary piston internal combustion engine according to the invention will be described in purely exemplary and non-limiting fashion, and their operation will be explained, wherein further details and advantages of the invention result from the drawings.

Figure 1:
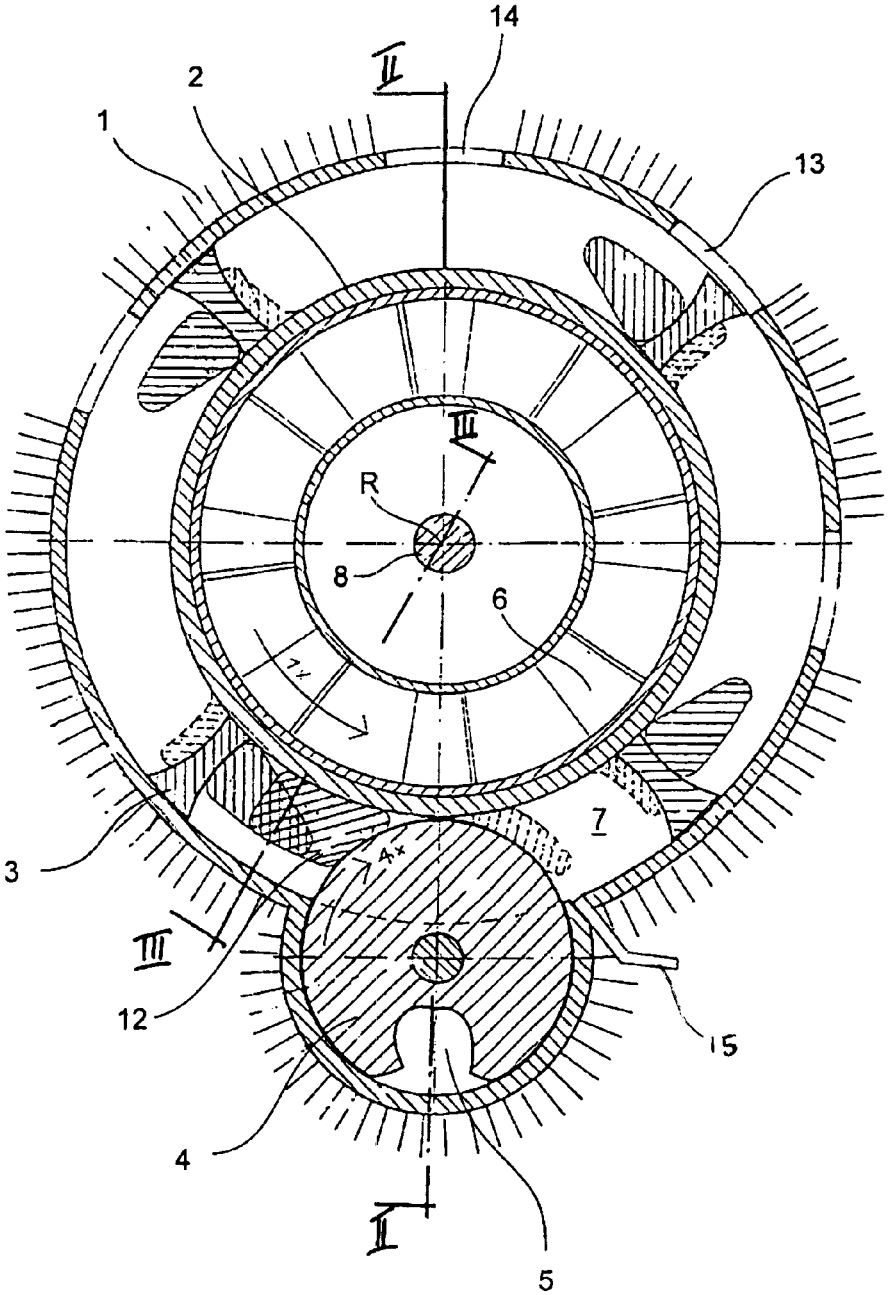
FIG. 1 shows a section extending perpendicularly to the axis of rotation of the working piston of a first embodiment of a rotary piston internal combustion engine wherein the working wheel has four working pistons and a counter wheel is provided with one working piston recess.
Figure 2:
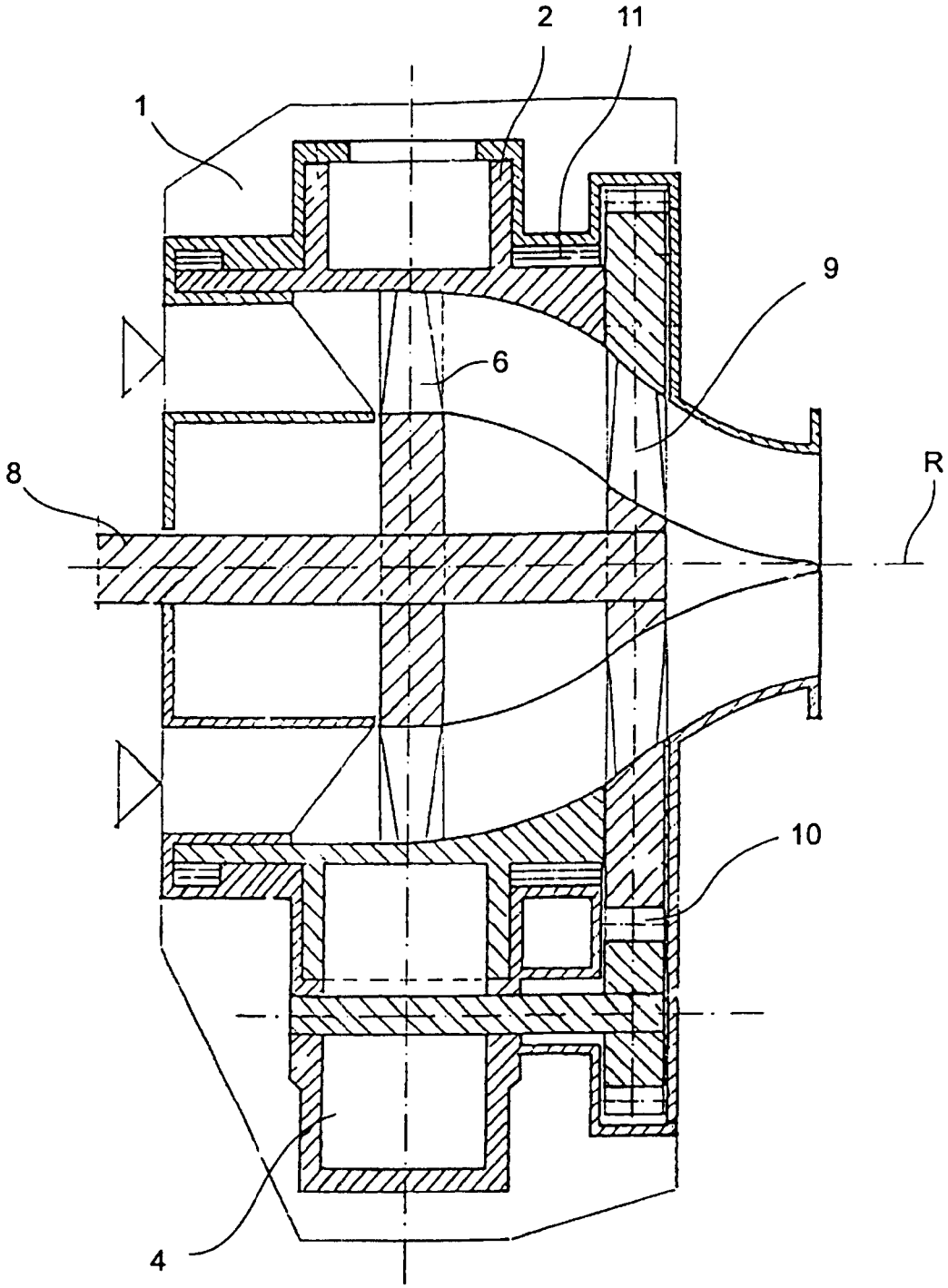
FIG. 2 shows a section along the line II—II in FIG. 1 of the rotary piston internal combustion engine according to FIG. 1.
Figure 3:
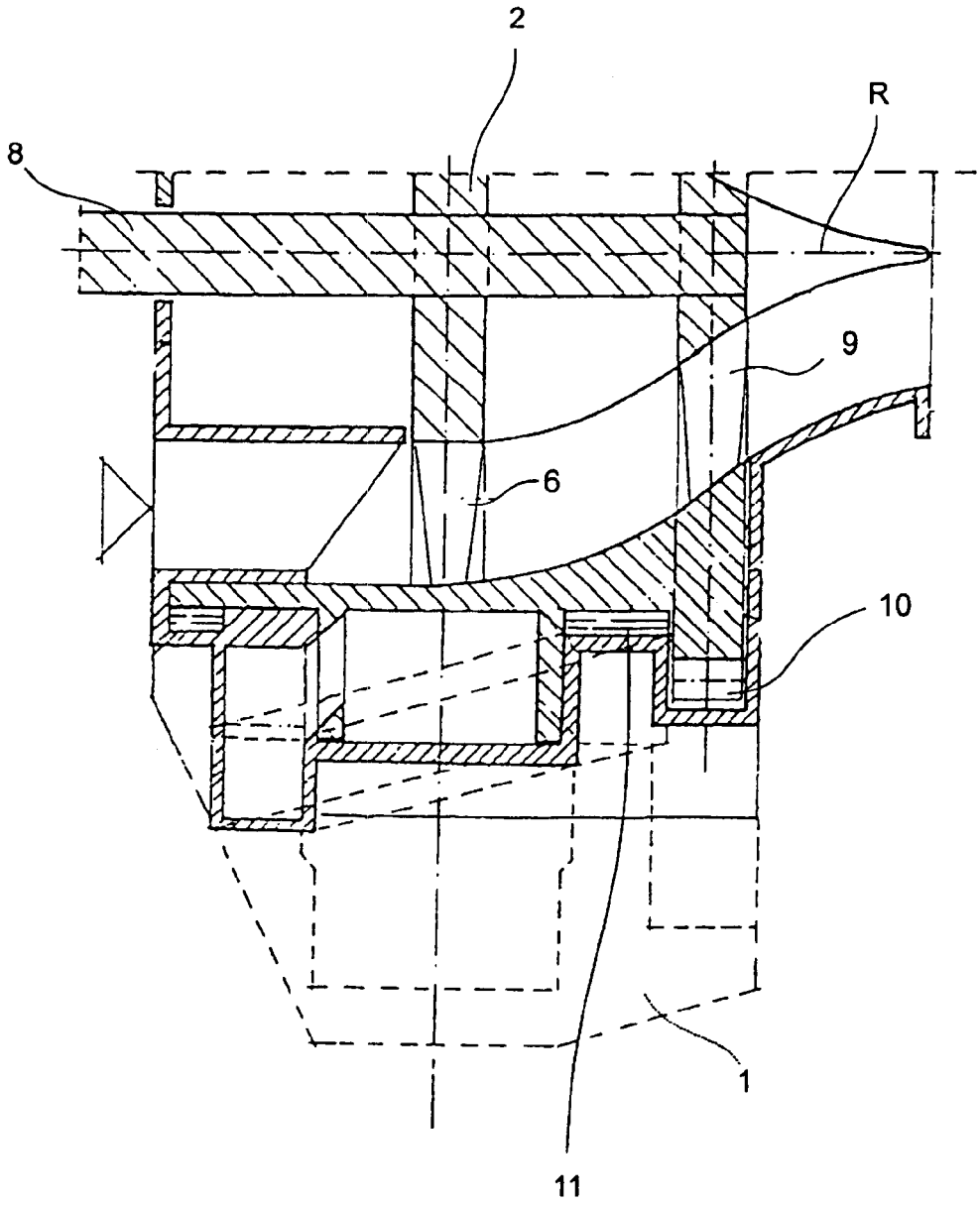
FIG. 3 shows a section along the line III—III of FIG. 1 through the rotary piston internal combustion engine according to FIG. 1.

In FIGS. 1 through 3 a rotary piston internal combustion engine is illustrated in which a working wheel 2 is rotatably supported in a housing provided with several cooling ribs.

The working wheel supports four working pistons 3 which in operation continuously move toward and away from a counter wheel 4 wherein a working piston recess 5 is provided in the counter wheel 4 so that the working pistons 3 mesh with the counter wheel 4 like gear wheels.

The working pistons 3 engage the working piston recess 5 which is designed such that rolling of the leading and outer edge of the working piston on the inner contour of the working piston recess results. At the bottom the counter wheel 4 is illustrated which is arranged such that the outer running surfaces of the counter wheel 4 and of the working wheel 2 roll on one another, i.e., the counter wheel 4 rotates in the clockwise direction while the working wheel 2 rotates in a counterclockwise direction. Between the working pistons 3, positioned in front of the counter wheel 4 in the rotary direction of the working wheel 2, the combustion chamber of the engine is formed as a result of the rotation. This combustion chamber is delimited by the inner side of the working piston 3 facing the counter wheel 4, by a part of the running surface of the counter wheel 4 as well as the inner wall of the working wheel 2 and the wall of the housing 1.

This housing 1 is formed at the side facing the working wheel 2 such that a fine running surface like a cylinder liner results for the working pistons 3. For this purpose, the housing 1 itself can be machined with such a quality or a stationary wheel can be provided that is inserted into the housing 1 and provides, like a cylinder liner, the required surface quality and running surface. The housing 1 or the stationary wheel of the housing 1 provides a receptacle for the counter wheel 4; the counter wheel also provides a running surface for a substantially gas-tight contact of the counter wheel 4 on the lateral wall of the housing 1. A reservoir 12 is arranged below the counter wheel 4 and its function will be explained in the following.

In the rotary direction, the pre-exhaust port as well as an intake 13 for the flushing air and an exhaust port 14 for a mixture of exhaust gas and flushing air is provided. Viewed farther in the rotary direction, an air intake port or an intake port for the fuel-air mixture is provided via which for the next combustion process the gas to be compressed can be taken in.

The working wheel 2 is comprised substantially of a pulley like configuration illustrated in section in the Figures. In the area of the upper and lower pulley plane a stay projects so that between these two projecting stays an annular channel is formed. In this annular channel, the working pistons 3 are arranged equidistantly which are formed here as flat stays which divide the annular channel of the working wheel 2 into four segments. Together with the inner wall of the housing 1 or of the stationary wheel of the housing 1, a closed space in the form of a torus segment with rectangular cross-section results which by rotation of the working wheel 2 is moved about the axis of rotation. Of course, the term closed in this connection does not preclude that a gas exchange with the exterior can take place via intake ports and exhaust ports.

In the interior area, the working wheel 2 has first air vanes 6 so that this inner area is formed like a turbine wheel. These air vanes 6 are connected with-their outer end to the groove-shaped outer area and with their inner ends connected to an inner hub. Preferably, the first air vanes 6 are concentric and symmetric to the axis of rotation R. By means of the first air vanes 6 and their angled position relative to the medium flowing through, the compression ratio, i.e., the pressure present behind the working wheel in the housing can be adjusted.

The function of the first air vanes can be seen best in the FIGS. 2 and 3. As illustrated here, air is taken in from the left side of the housing 1 by rotation of the working wheel 2 and flows through an inner flow channel. The air taken in and compressed in this way collects in an air collection container (not illustrated), which is flow-connected with an air intake port of the housing 1 into the channel of the working wheel 2 near the combustion chamber. In this way, compressed air can be made available without this requiring additional components for compression. In the illustrated embodiment, the engine has a second compression stage, which is formed by a gear rim 10 placed onto the shaft supporting the drive wheel 2. This gear rim 10 has actually the function of driving the counter wheel 4 and has, similar to the drive wheel 2, an inner area that is provided with second air vanes 9 through which a gaseous medium can flow.

By means of this overpressure, a fast filling action of the open volume, which is to form later on the combustion chamber, can be obtained without having to provide long valve opening times. Finally, the compressed air is used such that after combustion the space between two working piston 3 can be effectively flushed, i.e., possibly present gas residues resulting from the combustion can be removed. For this purpose, the chamber arranged in the housing 1 communicates with the compressed air by means of air intake port 13 that opens intermittently and through which the air can flow into the toroidal area of the working wheel 2 and can exit again through the exhaust port 14.

The embodiment illustrated in FIGS. 1 to 3 is only a principal illustration of an individual cylinder but is already fully functional. However, several working wheels are preferably used which can be arranged on a common output shaft 8 as well or on several shafts adjacent to one another. In this way, multi-row or multistage engines with several combustion chambers are possible. Finally, by employing several counter wheels 4 in connection with a common working wheel 2 and a corresponding number of working pistons 3 an engine can be configured in which each working wheel 2 is provided with several combustion chambers. In this connection, it is only important that behind the counter wheel 4 the afore described functional areas for exhausting and flushing the combustion residues are provided and, in front of the counterwheel 4, provisions for filling with ambient air and compression of the combustion air are provided. Behind the counter wheel 4 an injection nozzle is provided via which, for example, diesel fuel or kerosene can be injected into the combustion chamber.

Figure 4:
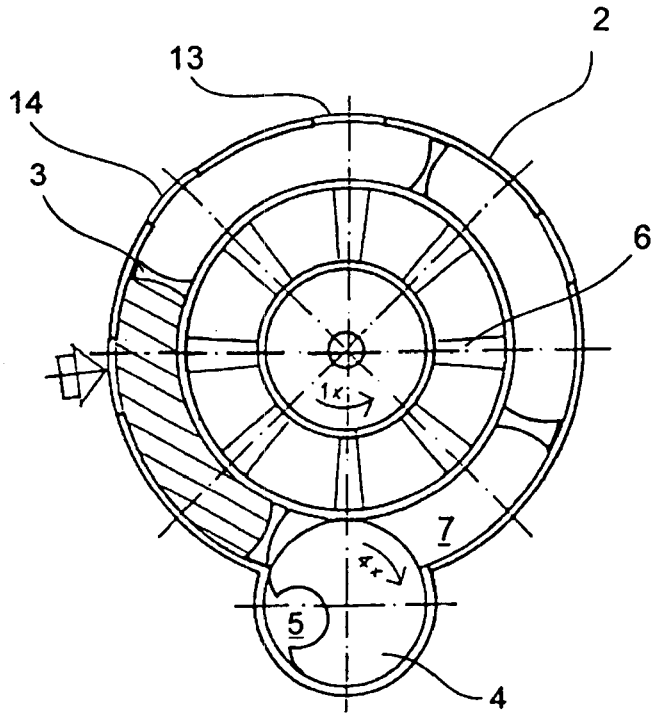
FIG. 4 shows schematically the first working step when operating a rotary piston internal combustion engine according to the invention, in particular, the supply of pre-compressed air into the space provided between the two working pistons, the housing, and the working wheel.
Figure 5:
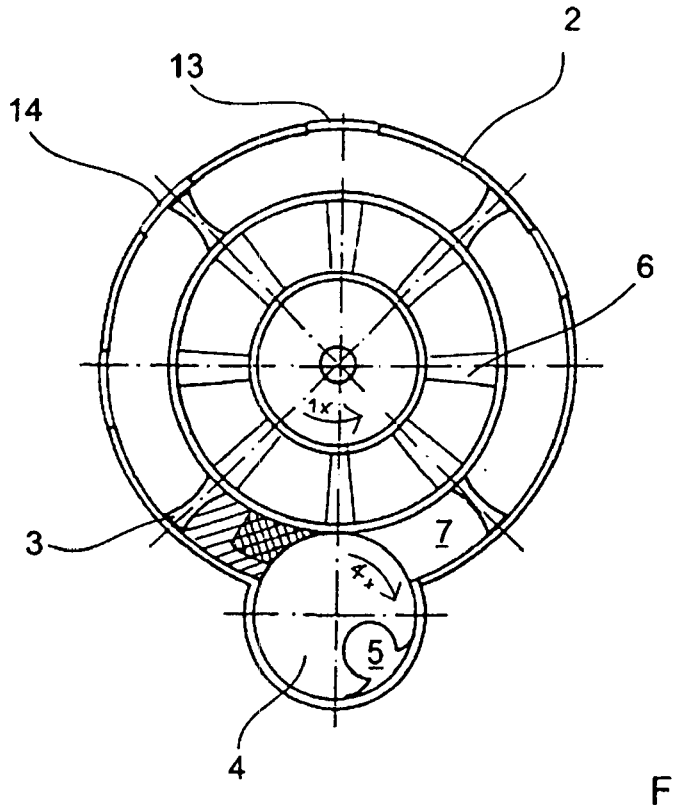
FIG. 5 shows schematically the second working step when operating a rotary piston internal combustion engine according to the invention, in particular, the compression of air and introduction of the compressed air into a reservoir, not illustrated in this drawing.
Figure 6:
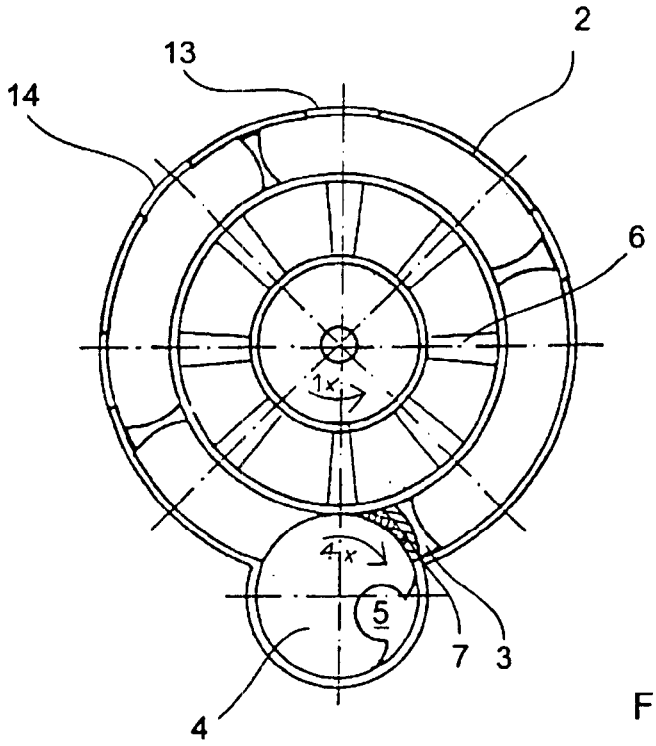
FIG. 6 shows schematically a third working step when operating a rotary piston internal combustion engine according to the invention, in particular, ignition of a fuel-air mixture.
Figure 7:
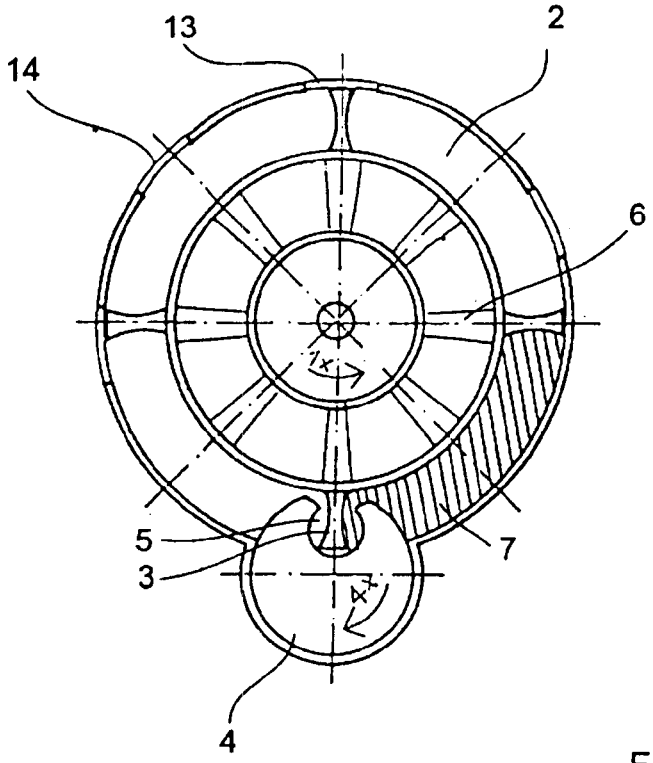
FIG. 7 shows schematically a fourth working step when operating a rotary piston internal combustion engine according to the invention, in particular, the expansion of the combustion chamber, formed by the counter wheel, working pistons, working wheel, and housing, by rotation of the working piston.
Figure 8:
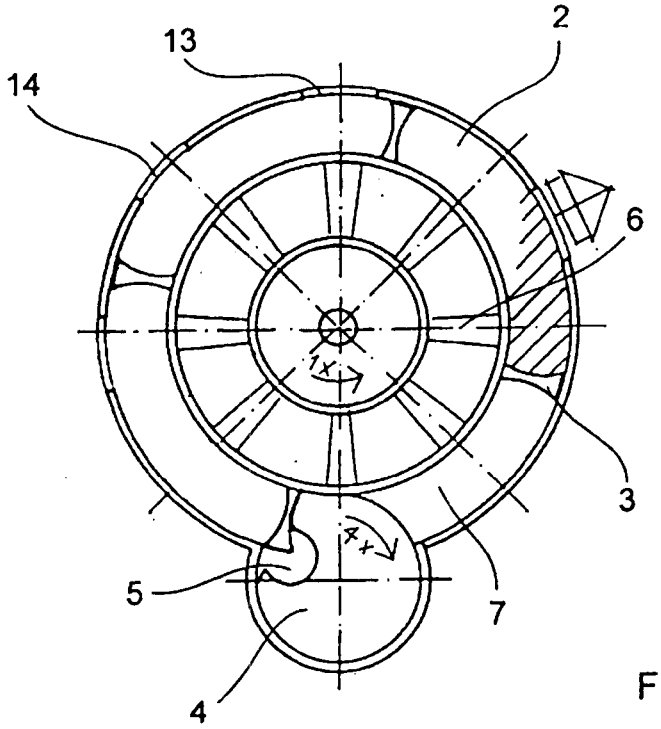
FIG. 8 shows schematically the fifth working step when operating a rotary piston internal combustion engine according to the invention, in particular, exhausting the exhaust gases from the combustion chamber through a first exhaust port provided in the housing.
Figure 9:
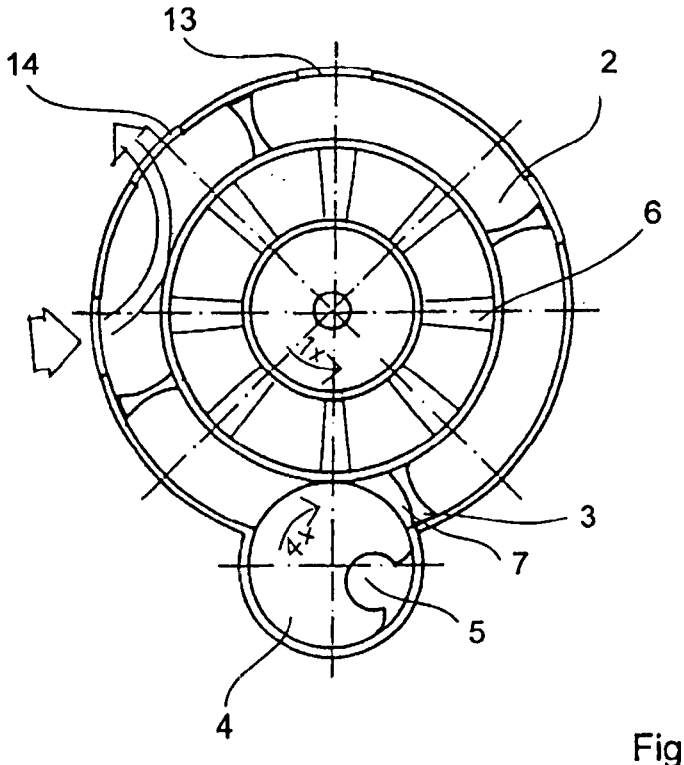
FIG. 9 shows schematically the sixth working step when operating a rotary piston internal combustion in the according to the invention, in particular, flushing of the space, in which, prior to this, combustion has taken place, by introducing pre-compressed air.

The exact method of taking in and compressing the medium and of the combustion process is explained in the following in connection with FIGS. 4 through 9. FIG. 4 shows the working wheel 2 in a position in which the pre-compressed ambient air has entered the future combustion chamber, i.e., the groove of the working wheel 2. By employing the ambient air, which has been compressed by the working wheel 2, a separate intake step is not required; as a result of the overpressure, ambient air continuously flows into the groove-shaped outer area of the working wheel 2.

As soon as one of the working pistons 3 passes the intake port of the compressed ambient air, one segment of the groove of the working wheel 3 is closed so that a closed pressure chamber results. The compressed medium which has entered in the above described way the channel of the working wheel 2 is now additionally compressed by further rotation of the working wheel 2. Depending on the basic type of the engine, the medium can be ambient air or can be a fuel-air mixture. The latter situation applies in the case of a gasoline engine while in the case of the diesel engine only ambient air is taken in. Upon further rotation of the working wheel 2, first a closed space is provided between the three chamber walls formed by the working wheel 2, the front side of the working piston 3, and the backside of the counter wheel 4 when the piston 3 passes the intake port.

This gas volume, which is under higher pressure in comparison to the ambient pressure, is now transported by the further rotation of the working wheel 2 in the direction of the counter wheel 4 and, by further advance of the working piston 3 toward the counter wheel 4, becomes increasingly smaller. This causes an increasing compression of the gas volume so that, according to a preferred embodiment, a pressure of, for example, approximately 40 bar is generated as a result of a compression ratio of 1:20. After final build-up of the working pressure, a laterally arranged pressure reservoir is opened so that the compressed medium can flow into this reservoir with slight decompression. In the sidewall of the groove-shaped channel of the working wheel 2, an opening is provided which, as a result of rotation of the working wheel 2, moves across the intake port for the reservoir 12 so that the intake port as well as the port in the working wheel 2 move more and more into a congruent position relative to one another.

In this way, the groove segment is flow-connected in the interior with the reservoir 12, and the compressed medium can flow into the reservoir 12. According to a preferred embodiment, an inner pressure of approximately 35 bar is then produced in the reservoir as a result of slight decompression. Further rotation of the working wheel 2 then causes the working piston 3 behind the now decompressed groove segment to mesh with the working piston recess 5 so that the working piston 3 can pass in the area of the counter wheel 4. By further rotation of the working wheel 2, behind the counter wheel 4 a closed torus segment is formed again by means of the same working piston 3 wherein, in the position illustrated in FIG. 6, the exhaust port of the reservoir 12 is congruent so that the compressed medium can flow out of the reservoir 12 into the torus segment behind the counter wheel 4.

In this way, the torus segment again fills with slight decompression with the compressed medium, which, for example, can have a pressure of 30 bar. The further rotation of the working wheel 2 by a rotary angle of a few degrees effects a movement of the lateral intake opening away from the exhaust port of the pressure reservoir 12 so that the torus segment is completely closed and forms a closed combustion chamber. By means of an ignition device, not illustrated in FIGS. 4 through 7, ignition can take place if the enclosed medium is a fuel-air mixture. In the case of a diesel engine, however, direct fuel injection is employed and, for this purpose, an injection nozzle 15 is provided behind the counter wheel 4, as, for example, illustrated in FIG. 1 and FIG. 16. In the case of direct injection, the gasoline in the illustrated situation is injected tangentially along the surface of the counter wheel 4.

As a result of the rotation of the counter wheel 4 counter to the injection direction, turbulence is created in the injected mist which, as a result of the rotation of the working wheel 2, will distribute within the combustion chamber. A glow filament effects the ignition of the mixture, which, as a result of combustion, will expand and drive the working piston 3 arranged in the leading area in the rotary direction of the working wheel 2.

For optimizing the combustion chamber 7, the form of the sidewalls and of the base of the groove-shaped channel can be modified according to the flow requirements. For example, it is possible that, instead of the illustrated planes on the surfaces of the counter wheel 4 and groove base of the drive wheel 2, a slightly crowned configuration of the counter wheel 4 and a matching negative shape of the groove base of the drive wheel 2 are selected. The injection angle relative to the two directions perpendicular to the axis of rotation R of the drive wheel 2 can be modified depending on the requirements in order to ensure a pollutant-reduced, 100% combustion.

After combustion, the drive wheel 2 is rotated father so that first a lateral pollutant exhaust port will flow-connect with the combustion chamber. Accordingly, the first exhaust gases will already escape and can be supplied to a conventional exhaust gas treatment and removal. A further rotation of the working wheel 2 then causes the chamber volume possibly still filled with residual gases to move into a position congruent with the intake port 13 connected to an ambient air volume which is under pressure. Upon flow communication of the chamber with the intake port 13, this ambient air flows into the chamber and exits by means of an exhaust port 14 while entraining the residual gases for the purpose of complete flushing.

The working pistons 3 have such an outer contour that in the upper area a large extension is provided which results in automatic sealing with the inner running surface of the housing 1. Additional sealing means, like piston rings in the case of a reciprocating piston engine, are not required. The working wheel 2 is supported by means of slide bearings 11 in the housing 1.

An important concept of the present intention resides in that the pre-compressed gaseous medium is compressed by the working wheel itself. For this purpose, the working wheel within the torus-shaped working area has a configuration like a turbine wheel. This turbine wheel is formed by first air vanes 6 taking in ambient air from the surroundings and making it available in a compressed state in a chamber volume. As illustrated in FIG. 2, a second compressor stage can be provided which additionally compresses the air; the chamber volume is connected to the flushing air intake port 13 as well as to the intake port of the gaseous medium to be compressed.

By means of the first compressor stage with the first vanes or, if present, by means of additional compression with the second compressor stage provided with second air vanes 9, the gaseous medium, for example, is available under pressure of 2.5 bar relative to the surroundings. This provides a fast and secure flowing of the ambient air into the respective volumes of the annular body without this requiring long opening times of the valves.

Figure 10:
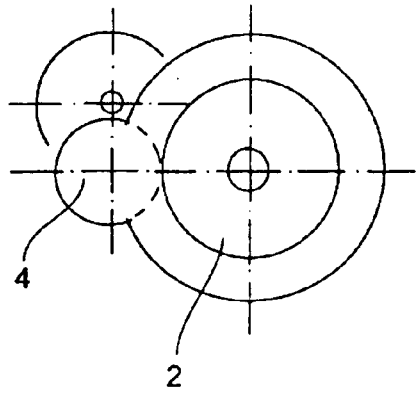
FIG. 10 shows purely schematically a possible arrangement of counter wheel, working wheel, and a separate output, viewed in the direction of the axis of rotation of the working wheel.
Figure 11:
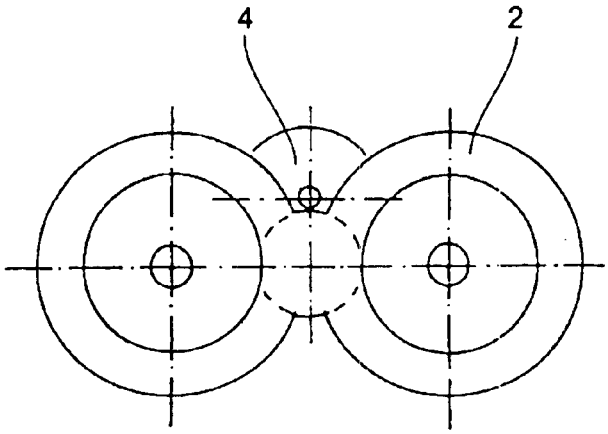
FIG. 11 shows purely schematically an arrangement comprising the counter wheel, two working wheels, and a separate output, viewed in the direction of the axis of rotation of the working wheels.
Figure 12:
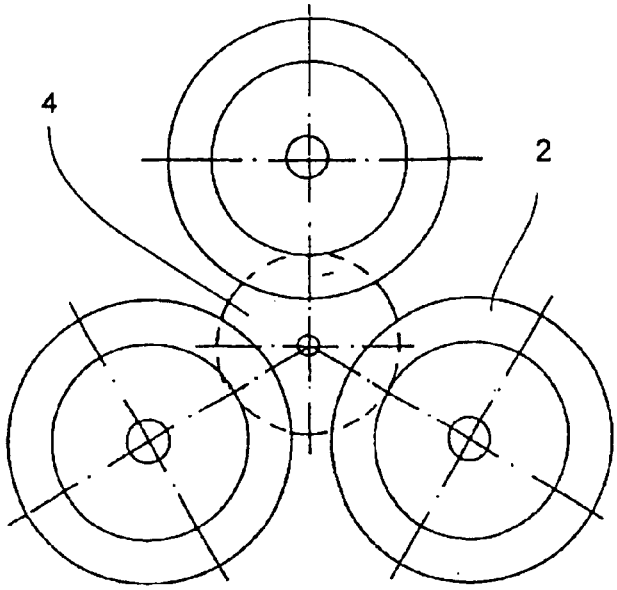
FIG. 12 shows purely schematically an arrangement comprising a counter wheel and three working wheels, viewed in the direction of the axis of rotation of the working wheels.

In FIGS. 10 and 11, further embodiments of the invention are illustrated. FIG. 10 shows a principal sketch of a single working wheel engine with only one drive wheel 2 and one counter wheel 4. FIG. 11 shows a further development of the engine with two drive wheels 2 which use a common counter wheel 4 for providing their function. In FIG. 12, a star-shaped configuration of a triple working wheel engine is provided which also uses a common counter wheel. This configuration is particularly advantageous because the shaft load onto the bearing of the counter wheel 4 compensate mutually. In this case, the bending load of the bearing of the counter wheel 4 is minimized which has positive effects with regards to wear as well as bearing losses. Instead of the illustrated configurations, on a common rotary shaft several drive wheels can be arranged sequentially so that a multi-stage engine with several drive wheels 2, rotatable about a common axis of rotation, results. In this case, each of the drive wheels 2 can cooperate with its own counter wheel 4; however, it is also possible to employ, instead of several contour wheels 4, a roller-shaped configuration of the counter wheel 4 so that this counter wheel 4 interacts with all employed drive wheels. This latter configuration is possible, of course, only when the angular position of the working pistons 3 in all drive wheels 2 is identical. The rotation of the drive wheels 2 relative to one another results in a smoother running of the engine and will thus justify the greater expenditure for the support of the different counter wheels 4.

Moreover, it is possible to combine a multi-row and a multi-stage engine with one another inasmuch as the spatial conditions allow for the resulting size. Also, for each drive wheel 2 several counter wheels 4 which are distributed about the circumference can be used, wherein for each employed counter wheel four working pistons 3 are provided on the drive wheel 2, respectively. In this way, several combustion chambers can be distributed about the circumference and, depending on the position of the counter wheels 4, a multi-cylinder motor with a corresponding smooth running can be configured. Generally, the smooth running quality of the engine according to the invention will be substantially higher in comparison to a reciprocating piston engine because the movement reversal of the moved masses is substantially prevented.

Figure 13:
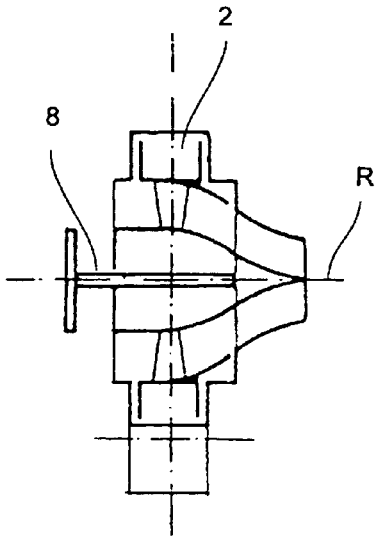
FIG. 13 shows purely schematically a rotary piston internal combustion engine with one working wheel, viewed in a direction perpendicular to the direction of the axis of rotation of the working wheel.
Figure 14:
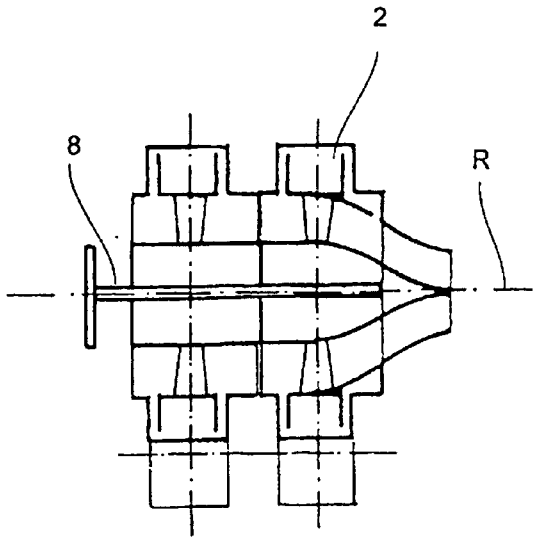
FIG. 14 shows purely schematically a rotary piston internal combustion engine with two working wheels arranged on a common axis of rotation, viewed in a direction perpendicular to the direction of the axis of rotation of the working wheels.
Figure 15:
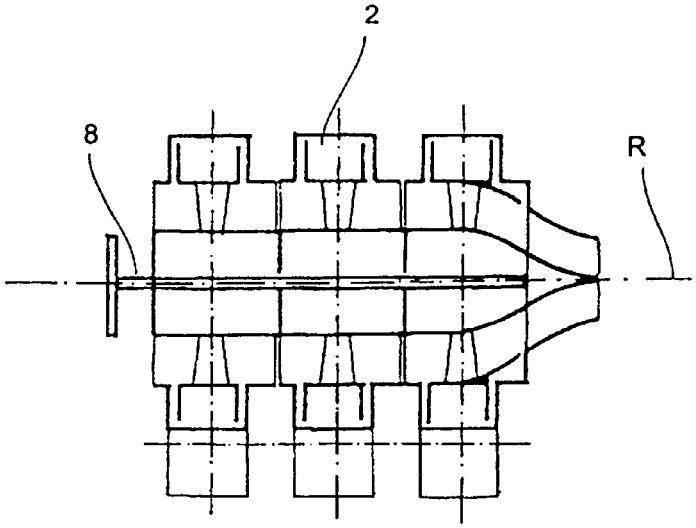
FIG. 15 shows purely schematically a rotary piston internal combustion engine with three working wheels arranged on a common axis of rotation, viewed perpendicularly to the direction of the axis of rotation of the working wheels.

FIGS. 13, 14, and 15 show a multi-row engine as already described above. All drive wheels are exposed to a common flow and have a turbine wheel, respectively. The overpressure available behind the turbine wheel can be supplied either directly to the respective openings of the drive wheels or can be guided behind the stack of turbine wheels into a common reservoir from where it is supplied to the corresponding ports.

Figure 16:
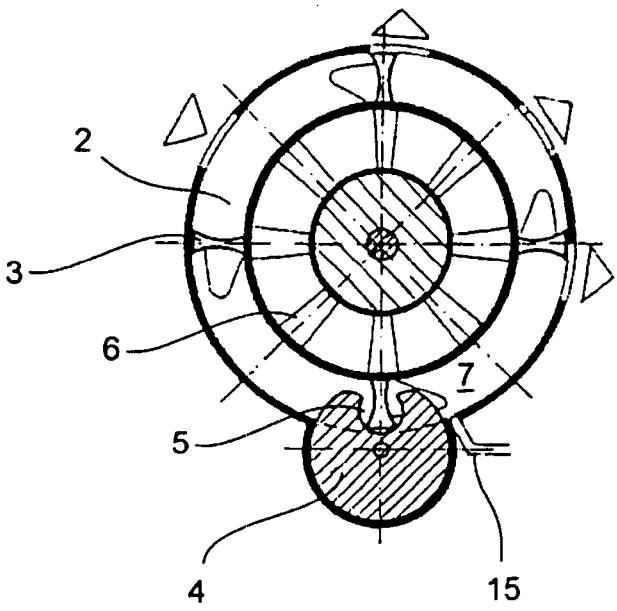
FIG. 16 shows schematically the intake of air into and the exhaust of air from the spaces formed between working wheel, housing, and working piston, viewed in the direction of the axis of rotation of the working wheel.
Figure 17:
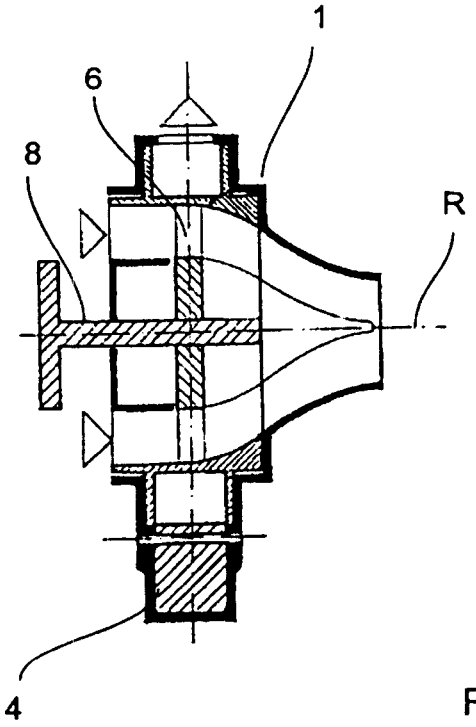
FIG. 17 shows schematically the intake of air through the working wheel and the exhaust of air from a space formed between the working wheel, housing, and working piston, viewed in a direction perpendicular to the direction of the axis of rotation of the working wheels.
Figure 18:
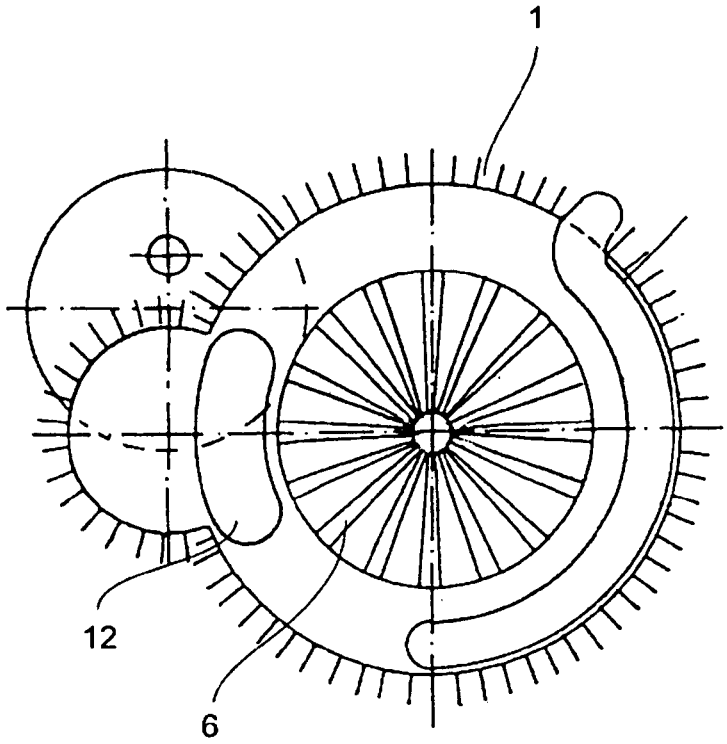
FIG. 18 shows a plan view onto a second embodiment and of a rotary piston internal combustion engine according to the invention with an output that is only schematically indicated, viewed in the direction of the axis of rotation of the blade wheel.
Figure 19:
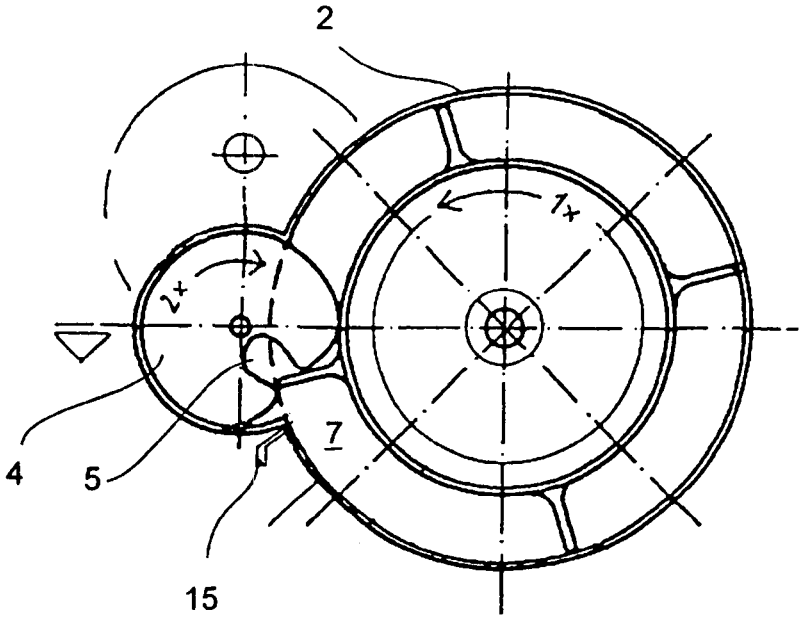
FIG. 19 shows a section of the rotary piston internal combustion engine according to FIG. 18 transverse to the axis of rotation of the blade wheel.
Figure 20:
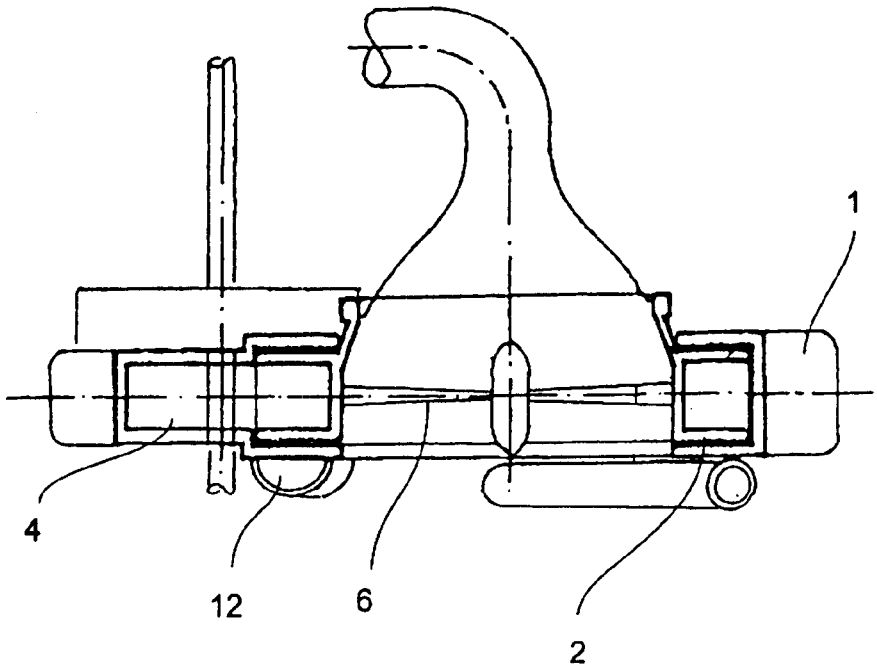
FIG. 20 shows schematically a side view of the rotary piston internal combustion engine according to FIG. 18.

FIGS. 16 and 17 show together with FIGS. 18 to 20 the above described single-stage configuration of the engine according to the invention. FIG. 18 shows the housing without the drive wheel 2 so that the reservoir 12 as well as the oppositely positioned exhaust gas removal can be seen. At the center of the housing the second compressor stage with the second air vanes 9 can be seen. FIG. 19 shows on the other hand the part of the engine not illustrated in FIG. 18 including the counter wheel 4 and the drive wheel 2. The counter wheel 4 rotates twice as fast as the drive wheel 2 so that an engagement of the working pistons 3 in the working piston recesses 5 is safely ensured. In the illustrated position the leading area of the working piston recess 5 rolls momentarily on the rear area of the working piston 3 so that shortly the flow connection to the reservoir 12 for filling the combustion chamber with compressed medium is realized. FIG. 20 shows a side view of the engine illustrated in FIGS. 18 and 19 in which the reservoir 12 can be seen especially well.

While specific embodiments of the invention have been shown and described in detail to illustrate the inventive principles, it will be understood that the invention may be embodied otherwise without departing from such principles.

What is claimed is:

1. A rotary piston internal combustion engine comprising:

a housing;

at least one working wheel mounted rotatably about an axis of rotation in the housing;

at least one working piston provided on the working wheel for taking in and compressing air or a fuel-air mixture and for converting the gas pressure resulting from combustion of a fuel-air mixture into mechanical energy;

at least one counter wheel with at least one working piston recess;

at least one combustion chamber for combusting a fuel-air mixture, wherein the at least one combustion chamber in operation is formed continuously anew between the at least one working piston, the at least one working wheel, the at least one counter wheel, and the housing;

a number of first air vanes driveable in rotation for pre-compression of air or of a fuel-air mixture, wherein the first air vanes, in the form of spokes, are a part of the at least one working wheel and in operation take in the fuel-air mixture or the air through the working wheel;

wherein the at least one working wheel is pulley-shaped and comprises at least one annular channel extending peripherally on the at least one working wheel in a circumferential direction and being interrupted by the at least one working piston;

wherein the at least one working piston is arranged fixedly in the at least one annular channel.

2. The rotary piston Internal combustion engine according to claim 1, wherein the at least one working piston is embodied as a flat stay.

3. The rotary piston internal combustion engine according to claim 1, wherein at least two of the working pistons are arranged on the at least one working wheel, wherein the at least two working pistons are arranged equidistantly in the at least one annular channel and divide the at least one annular channel in segments of identical size.

4. The rotary piston internal combustion engine according to claim 3, wherein the at least one counter wheel during operation has an angular speed greater than the angular speed of the at least one working wheel.

5. The rotary piston internal combustion engine according to claim 1, wherein the fuel-air mixture or the air flows substantially parallel to the axis of rotation of the at least one working wheel.

6. The rotary piston internal combustion engine according to claim 1, further comprising an output shaft connected to the at least one working wheel and having an axis of rotation coinciding with the axis of rotation of the at least one working wheel.

7. The rotary piston internal combustion engine according to claim 6, wherein the first air vanes are fastened on the output shaft.

8. The rotary piston internal combustion engine according to claim 6, further comprising a first gear rim arranged on the at least one working wheel, wherein the first gear rim drives directly or indirectly the output shaft.

9. The rotary piston internal combustion engine according to claim 6, further comprising several second air vanes driveable in rotation for additional pre-compression of the air or of the fuel-air mixture.

10. The rotary piston internal combustion engine according to claim 9, wherein the second air vanes, in the form of spokes, are a part of the first gear rim.

11. The rotary piston internal combustion engine according to claim 10, wherein the second air vanes engage the output shaft.

12. The rotary piston internal combustion engine according to claim 10, wherein the first gear rim is fixedly connected to the at least one working wheel.

13. The rotary piston internal combustion engine according to claim 12, wherein the at least one counter wheel has a second gear rim, wherein the first gear rim meshes with the second gear rim and wherein the second gear rim at is at least partially complementary to the first gear rim.

14. The rotary piston internal combustion engine according to claim 13, further comprising a drive chain driven by the first gear rim, wherein the at least partially complementary second gear rim is driven by the drive chain driven by the first gear rim.

15. The rotary piston Internal combustion engine according to claim 14, further comprising a slide bearing for supporting the at least one working wheel in the housing, wherein the slide bearing is arranged between an inner side of the housing and an outer side of the at least one working wheel facing the housing.

16. The rotary piston internal combustion engine according to claim 1, further comprising a reservoir for receiving air or a fuel-air mixture compressed during operation by the at least one working piston when the at least one working piston passes through the at least one counter wheel.

17. The rotary piston internal combustion engine according to claim 16, wherein the reservoir is arranged in the counter wheel.

18. The rotary piston internal combustion engine according to claim 1, wherein the at least one working wheel is a common working wheel for at least two of the working pistons, wherein the housing has at least one intake port and at least one exhaust port formed such that, in certain rotational positions of two neighboring ones of the working pistons, the at least one intake port and the at least one exhaust port are open at the same time so that a flow of flushing air is enabled through the at least one intake port into a space formed between the two neighboring working pistons, the housing, and the common working wheel for forcing out exhaust gases present in the space through the at least one exhaust port.

19. The rotary piston internal combustion engine according to claim 1, embodied as a multi-row engine, provided with at least two of the working wheels, arranged behind one another such that the axis of rotation of each one of the working wheels coincide, and at least two of the counter wheels, wherein each one of the working wheels has one of the counter wheels assigned thereto.

20. The rotary piston internal combustion engine according to claim 1, wherein several of the working wheels are arranged in the housing and wherein for at least some of the working wheels the axis of rotation does not coinciding with the axis of rotation of other working wheels.

21. The rotary piston internal combustion engine according to claim 20, wherein the at least one counter wheel is a common counter wheel for at least two of the working wheels, wherein the at least two working wheels are arranged in the housing such the axis of rotation of the at least two working wheel do not coincide.

22. The rotary piston internal combustion engine according to claim 1, wherein the at least one working piston has a cooling channel having a first end opening in an area in front of the first air vanes and having a second end opening in an area behind the first air vanes (6), wherein the cooling channel has a substantially U-shaped cross-section.

* * * * *